United States Patent [19]

Katoh et al.

[11] Patent Number: 4,981,531

[45] Date of Patent: Jan. 1, 1991

[54] PROCESS FOR PRODUCING COLD ROLLED STEEL SHEETS HAVING EXCELLENT PRESS FORMABILITY AND AGEING PROPERTY

[75] Inventors: Hiroshi Katoh; Hiromi Toyota; Kazuo Koyama; Kunihiko Komiya, all of Chiba, Japan

[73] Assignee: Nippon Steel Corporation, Tokyo, Japan

[21] Appl. No.: 551,369

[22] Filed: Nov. 14, 1983

Related U.S. Application Data

[63] Continuation of Ser. No. 416,372, Sep. 9, 1982, Pat. No. 4,443,272.

[30] Foreign Application Priority Data

Sep. 19, 1981 [JP] Japan ..... 56-148323

[51] Int. Cl.[5] ..... C21D 8/04

[52] U.S. Cl. ..... 148/12 C; 148/12.3

[58] Field of Search ..... 148/12 C, 12.3, 12 D

[56] References Cited

U.S. PATENT DOCUMENTS

| | | | |
|---|---|---|---|
| 3,805,571 | 4/1974 | Toda et al. | 266/108 |
| 3,920,487 | 11/1975 | Gondo et al. | 148/12 C |
| 4,374,682 | 2/1983 | Abe et al. | 148/12 C |
| 4,443,272 | 4/1984 | Katoh et al. | 148/12 C |

FOREIGN PATENT DOCUMENTS

| | | | |
|---|---|---|---|
| 135616 | 10/1979 | Japan | 148/12 C |
| 91929 | 7/1980 | Japan | 148/142 |
| 110735 | 8/1980 | Japan | 148/12 D |
| 115948 | 9/1980 | Japan | 148/12 C |
| 145123 | 11/1980 | Japan | 148/12 C |
| 35726 | 4/1981 | Japan | 148/12 C |
| 136956 | 10/1981 | Japan | 148/12 C |

*Primary Examiner*—Peter K. Skiff

*Attorney, Agent, or Firm*—Cushman, Darby & Cushman

[57] ABSTRACT

Disclosed are processes for producing cold rolled steel sheets and strips having excellent press formability and ageing property by a continuous annealing method, in which specific heating cycles are adopted in combination with steel compositions with lowered phosphorus contents.

10 Claims, 1 Drawing Sheet

PROCESS FOR PRODUCING COLD ROLLED STEEL SHEETS HAVING EXCELLENT PRESS FORMABILITY AND AGEING PROPERTY

This is a continuation of application Ser. No. 416,372, filed Sept. 9, 1982, now U.S. Pat. No. 4,443,272.

BACKGROUND OF THE INVENTION

1. Field of the Invention

The present invention relates to a process for producing cold rolled steel sheets or strips (hereinafter called as steel strip) having excellent press formability and ageing property using specific steel compositions and specific heat cycles in continuous annealing.

Cold rolled steel strips have been widely used in many applications including automobile bodies, furniture, office instruments, electric appliances and are very closely related with us.

Cold rolled steel strips are nowadays produced in steel making plants with modern equipments, and the most of the steel strip production is press formed with press molds into various complicated shapes for final applications.

Therefore, cold rolled steel strips, which must withstand the severe press forming, are required to have a satisfactory press formability including satisfactory drawability into press molds of cubic structure without fracture, as well as satisfactory press formability, namely the property that the steel strip, when pressed into the mold, hardly surrender to the thickness reduction and the fracture.

Further, cold rolled steel strips are required to have a good ageing property that the above properties will not deteriorate along the elapse of the time after their production, particularly they must be prevented from development of the so-called stretcher strains, or strain patterns which damage the surface quality of the final products.

2. Description of the Prior Arts

Conventionally, in order to meet with the above requirements, cold rolled steel strips were produced with application of box annealing, requiring ten or more days for the full treatment. Recently, continuous annealing processes have been more and more widely adopted for the production of cold rolled steel strips, thereby efficient annealing can be performed only in about 10 minutes, as compared with the long time required by the box annealing, and a uniform quality can be obtained through the whole length of the steel strips.

However, the conventional continuous annealing processes have a disadvantage that the workability, particularly press formability of the steel strips obtained is no better than that obtained by the box annealing and the ageing property by the conventional continuous annealing processes is remarkably inferior to that obtained by the box annealing.

Therefore, many efforts have been made by the present inventors for producing cold rolled steel strips satisfying the requirements of both the press formability and the ageing property as mentioned above at low production cost.

Conventionally are known methods in which precious elements, such as titanium and niobium, are added for improving the press formability and the ageing property, but these methods require incorporative use of additional treatments, such as a vacuum degassing treatment, thus necessitating increased production costs. Also, it has conventionally been practiced to raise the hot rolling coiling temperature for the above purposes, but the resultant press formability and ageing property are far inferior to those obtained by the box annealing. Further, most of the cold rolled steel strips produced by continuous annealing have disadvantages that they are susceptible to deterioration of the press formability along the elapse of time while they are left at room temperatures after their production, and they are also susceptible to development of the stretcher strain due to redevelopment of the yield point elongation. These disadvantages are most probably attributable to the fact that the cold rolled steel strips as continuously annealed contain more residual solid solution carbon than the strips obtained by the box annealing.

In order to reduce the solid solution carbon, it has been conventionally practiced to apply an overageing treatment at a temperature from 300° to 450° C., but this is very difficult to reduce effectively the solid solution carbon to the level obtained by the box annealing in a limited time during the continuous annealing process; for example, in only several minutes of overageing treatment. For these reasons, it has been proposed to cool the strips continuously from the annealing temperature to the overageing temperature or to cool the strips to a temperature below the overageing temperature and reheat the strips again to the overageing temperature. In the former case where the cooling is done continuously, the solid solution carbon precipitates at the grain boundaries so that the solid solution carbon is very likely to remain in the strips although a satisfactory drawability and press formability can be obtained. Therefore, the resultant steel strips are inferior in the ageing property, thus failing to provide an ageing property comparable with that obtained by the box annealing.

In the latter case where the reheating is done after the overcooling, the driving force for the carbon precipitation has been given by the overcooling so that the reduction of solid solution carbon can be promoted more rapidly than in the former case, but the precipitated carbide is finely dispersed in the grains so that the resultant press formability tends to deteriorate.

It has been conventionally known that when precipitates, such as AlN, MnS, BN, etc. are present in the steel strips after the soaking, the precipitation of solid solution carbon is promoted by these precipitates which act as the precipitation core so that the reduction of solid solution carbon can be effected rapidly. However, the steel material for the continuous annealing is generally given in the form of hot rolled steel strips as coiled at high temperatures, in which the precipitated particles, such as AlN are coarsened and scarcely dispersed, thus failing to effectively serve as the precipitation core for the solid solution carbon.

Meanwhile, trials of softening the steel by adjustments of chemical compositions, or enlarging the grain growth by a high temperature annealing have been made, but found to be undesirable from the point of the reduction of solid solution carbon, because these trials rather increase the dispersion distance of the solid solution carbon to the grain boundary.

Extensive and detailed studies have been made by the present inventors on chemical compositions of the steels and heat-cycles of the continuous annealing which may have influences on the resultant press formability and ageing property, and it has been found that remarkable improvement of the press formability can be achieved by lowering phosphorus contents in the steels and that the carbides can be dispersed in a harmless form to the ductility of the steels by controlling the overageing treatment in the continuous annealing step in combination with the lowering of the phosphorus contents, and thus dispersed carbides can be made to serve as the precipitation core for the solid solution carbon, thereby it is possible to produce cold rolled steel strips having press formability and ageing property equal to or better than those obtained by the box annealing.

As a process for producing cold rolled steel strips having excellent press formability and ageing property by continuous annealing, it is known, as disclosed in U.S. Pat. No. 3,920,487, to stepwisely or continuously lowering the strip temperature from the starting temperature, 400° to 500° C., of an overageing treatment to precipitate carbides at grain boundaries at the initial stage of the overageing. This prior art severely avoids the formation of fine carbides in the grains so as to prevent deterioration of the press formability in particular, and has a problem that it is impossible to remarkably lower the yield point elongation simultaneously wit remarkable improvement of the press formability.

SUMMARY OF THE INVENTION

The main object of the present invention is to provide a process for producing cold rolled steel strips having press formability and ageing property equal to or better than those obtained by the box annealing, and the process according to the present invention comprises continuously casting a molten steel into slabs, said steel containing:

not more than 0.1% carbon,
not more than 0.5% manganese,
not more than 0.008% phosphorus,
not more than 0.08% aluminum,
not more than 0.005% nitrogen, and optionally
not more than 0.005% boron,
with the balance being iron and unavoidable impurities, hot rolling the slab thus obtained with a finishing temperature not lower than $A_3$ point and a coiling temperature from 600° to 750° C., cold rolling the hot rolled steel strip thus obtained, and continuously annealing the cold rolled steel strip, said continuous annealing comprising; heating the strip at a temperature ranging from 680° to 850° C., cooling the strip from $A_1$ point to a temperature ranging from 450° to 350° C. with a cooling rate not less than 50° C./sec., holding the strip isothermally at the temperature thus cooled for one to three minutes, cooling the strip again and holding the strip again isothermally at the temperature thus cooled in a temperature range of from 300° to 200° C. for at least one minute, and cooling the strip to room temperature.

DETAILED DESCRIPTION OF THE INVENTION

Description will be hereinunder made on the chemical compositions and the heat cycles in the continuous annealing according to the present invention.

Carbon is well known to have a great influence on the mechanical properties of cold rolled steel strips, and the press formability and the drawability of the steel can be improved by lowering the carbon content. On the other hand, with carbon contents exceeding 0.1%, a large amount of pearlite is produced in the cooling step when the strip is subjected to annealing at a temperature not lower than $A_1$ point, and tendencies are remarkable that the yield point rises and the press formability deteriorates. Therefore, the carbon content in the present invention is limited to amounts not larger than 0.1%. Where a high degree of drawing and stretching are required, it is desired to maintain the carbon content to amounts not larger than 0.02%, but where the yield point elongation is desired to be maintained to a minimum (for example, 0.2%), it is rather desirable to maintain the carbon content to amounts from 0.02 to 0.04%.

Manganese also is an element not only effective to promote the formation of pearlite, but also effective to strengthen the steel when present in the form of solid solution, and manganese contents not less than 0.5% will cause increases in the yield point and the tensile strength. Therefore, the manganese content in the present invention is limited to amounts not more than 0.5%.

Phosphorus is the most important element in the present invention and it has been found that when the phosphorus content is lowered to amounts not more than 0.010%, the elongation value as estimated by the tensile test markedly improves. Thus in the present invention, the phosphorus content is limited to amounts not more than 0.010%. The relation between the phosphorus contents (%) in the steel strip and the elongation of the strip which has been subjected to 1.0% skin-pass rolling and artificially aged at 100° C. for 60 minutes is shown in FIG. 2, from which it is clearly understood that the elongation can be remarkably improved by maintaining the phosphorus content to amounts not more than 0.010%.

Figure 1:
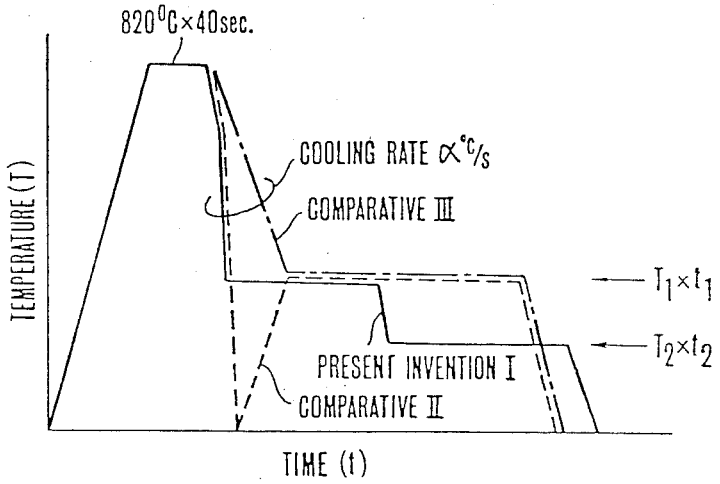
FIG. 1 is a graph schematically showing the heating pattern according to the present invention in comparison with the comparative methods.
Figure 2:
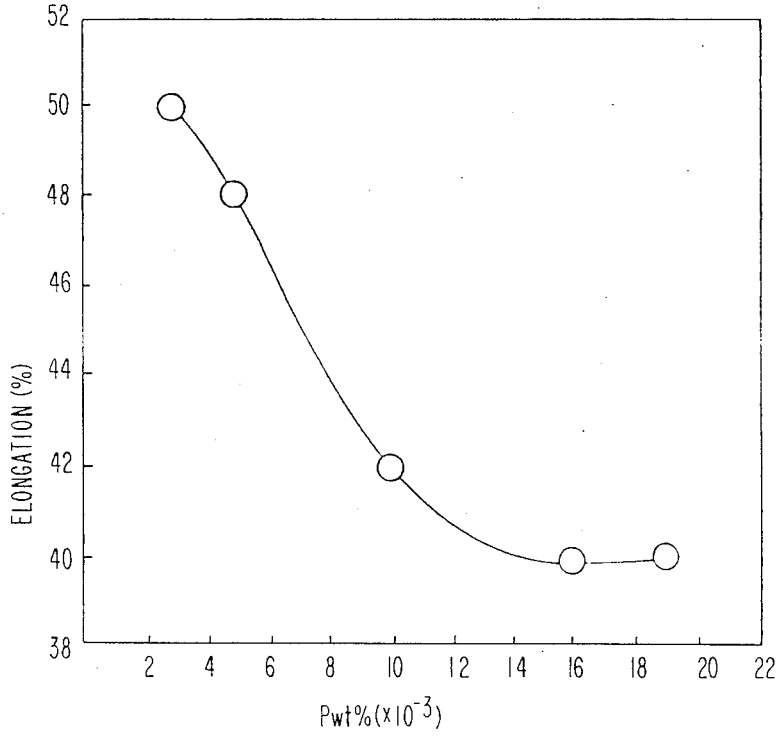
FIG. 2 is a graph showing the relation between the phosphorus content and the elongation of the cold rolled steel strip produced according to the present invention.

The steel used in FIG. 2 has a basic steel composition:

0.022 to 0.032% carbon,
0.19 to 0.23% manganese,
0.026 to 0.030% aluminum,
0.019 to 0.034% nitrogen, and has been subjected to the heat-cycle (I) of continuous annealing as shown in FIG. 1; thus Soaking: at 850° C. for 60 seconds,
Cooling rate $\alpha$: 70° C./sec.,
$T_1$: 400° C., $t_1$: 3 minutes
$T_2$: 300° C., and $t_2$: 3 minutes.

Lower phosphorus contents are more desirable, and due to the recent technical developments in dephosphorization, such as blowing of FeO and CaO into the molten steel together with inert gas, the phosphorus content can be easily reduced to 0.005% or lower at low costs. Therefore, in the present invention, it is desirable to maintain the phosphorus content at 0.005% or lower.

Aluminum is used as deoxidizer, and when aluminum contents exceed 0.08%, the starting temperature of recrystallization of the steel rises, and the grain size after the annealing is caused to be fine so that the resultant yield point rises and the hardness increases. Therefore, in the present invention, the aluminum content is limited to amounts not more than 0.08%.

Nitrogen, when present in solid solution in the steel, tends to deteriorate the ageing property of the steel and lower the press formability, and therefore, it is necessary to fix the nitrogen with aluminum.

For efficient formation of AlN with a coiling temperature not lower than 600° C. as adopted in the present invention, the nitrogen content should be 0.005% or less. Otherwise, the solid solution nitrogen is more likely to be retained. Therefore, in the present invention, the upper limit of the nitrogen content is set at 0.005%.

For fixing nitrogen, it is desirable that not larger than 0.005% boron is present in the steel.

Regarding the aluminum and nitrogen contents according to the present invention, they may be present in amounts normally obtained in ordinary steel making processes, but their preferable ranges are 0.02 to 0.04% for aluminum and 0.0020% for nitrogen. If boron, which is optionally added, is present in solid solution, it rather tends to deteriorate the drawability. Therefore, it is desirable to maintain the ratio of boron to nitrogen in a range of from 0.5 to 1.0.

It has been found to be effective for improving the press formability to maintain the slab heating temperature at a relatively lower level as about 1100° C. while maintaining the finishing temperature not lower than $A_3$ point in the hot rolling step. In the present invention, the finishing temperature in the hot rolling step is maintained not lower than $A_3$ point, because with a finishing temperature below $A_3$ point, the grains grow irregularly in the thickness direction of the hot rolled strip and this irregular grain growth is retained even after the cold rolling and annealing, thus causing the surface roughening during the press forming and also lowering the press formability. Then the strip is coiled in a temperature range of from 600° to 750° C. This is essential for coagulation of the solid solution carbon in the steel to the grain boundaries and additionally for precipitation of coarse AlN, thus assuring a large grain growth after the continuous annealing and hence an improved press formability. With lowered phosphorus contents in the steel, the carbon coagulation can be easily effected, but if the coiling temperature is below 600° C., only insufficient carbon coagulation can be achieved. Therefore, the lower limit of the coiling temperature is set at 600° C. in the present invention. With higher coiling temperatures, both the press formability and drawability of the steel can be improved, but with coiling temperature beyond 750° C., a larger amount of oxide scale is formed during the subsequent cooling of the hot rolled strip, thus requiring a longer time for the descaling such as by acid-pickling. Therefore, in the present invention, the upper limit of the coiling temperature is set at 750° C.

Then in order to obtain grain sizes large enough for improving the press formability after the cold rolling, it is necessary to heat the strip at a high temperature not lower than 680° C. and soak the strip at the temperature. However, if the heating and soaking temperature exceeds 850° C., the (1 1 1 ) plane diminishes due to the transformation, resulting in deterioration of the drawability and the pearlite phase detrimental to the press formability is produced during the cooling. Therefore, the heating and soaking temperature in the present invention is limited to the range of from 680° to 850° C. Then the cooling step from $A_1$ point after the heating and soaking is very important for efficiently reducing the solid solution carbon most harmful to the ageing property so as to assure a solid solution carbon level equal to those obtained by the box annealing.

In the present invention, the cooling from $A_1$ point with a cooling rate of not less than 50° C./sec. to the temperature range of from 450° to 350° C. is intended for dispersing precipitates of cementite with several micron spaces within the grains in a harmless form to the press formability in particular. If the cooling rate is less than 30° C./sec., the cementite will preferentially precipitate only at the grain boundaries and no cementite will be produced in the grains. For these reasons, the cooling rate should be not less than 30° C./sec., preferable not less than 50° C./sec, in the present invention.

Regarding the temperature range of from 450° to 350° C. to which the strip is cooled in the present invention, if the cooling temperature is higher than 450° C., the amount of the carbon which dissolves in solid solution at this temperature increases to 20 to 30 ppm and it is impossible to produce the cementite in the grains, however, the cooling rate may be increased. On the other hand, if the cooling temperature is lower than 350° C., fine cementite will be dispersed, however the cooling rate may be selected, so that the press formability is deteriorated. Further, no cementite will be produced in the grains unless the strip is held in the cooling temperature range of from 450° to 350° C. for at least one minute, but on the other hand, even if the strip is held in the temperature range of for longer than 3 minutes, no additional effect can be obtained, because the dispersion of carbide has been substantially saturated. Therefore, in the present invention, the upper limit time and lower limit time for holding the strip in the cooling temperature range are set respectively at 3 minutes and on minute. Subsequently, the strip is subjected to a final precipitation treatment for precipitating the solid solution carbon in a temperature range of from 300° to 200° C.

This treatment is intended to promote the precipitation of the solid solution carbon by efficiently utilizing the cementite as precipitation core controlled in its dispersion, and for this purpose the treatment must be done at a temperature lower than the lower limit of the first step cooling temperature, thus at temperatures higher than 300° C., the solid solution limit of carbon is large, while at temperatures lower than 200° C., the dispersion rate of carbon is remarkably reduced, so that no efficient reduction of the solid solution carbon can be achieved. Therefore, in the present invention, the precipitation treatment is done in the temperature range of from 300° to 200° C. for at least one minute.

The cooling conditions after the heating and soaking can be basically applied to the ordinary continuous annealing process and are advantageous for production of steel strips having excellent workability, but the present invention is characterized not only by the overageing treatment, but also by the development of the latent effects of the overageing treatment by combining it with the low-phosphorus steels.

Thus, when the phosphorus content in steels is lowered, the recrystallization proceeds quickly during the continuous annealing so that the grain growth is rapidly effected, and as the grown grains have a uniform distribution in size, the workability, particularly the press formability is remarkably improved.

Therefore, according to the present invention, not only the chemical composition of the starting steel material is limited, but also the specific hot rolling conditions and specific continuous annealing conditions are combined so as to obtain cold rolled steel strips having workability equal to or better than that obtained by the conventional box annealing.

What is most important in the present invention is that the phosphorus content in steels is reduced so that a rapid recrystallization, and a quick grain growth can be effected during the continuous annealing, and that the grown grains have a uniform distribution in size, so that the workability, particularly the press formability is remarkably improved.

Regarding the continuous annealing system used in the present invention, an ordinary continuous annealing furnace designed especially for treating cold rolled steel strips, comprising an electric cleaning step, an annealing step and a skin-pass rolling step arranged in succession may be used. Further, for production of cold rolled steel strips directed for applications where improved corrosion resistance is required, the continuous annealing system may include additional equipments for applying low-melting point metal or alloy coatings, such as aluminum coating, zinc coating and tin coating.

Regarding the cooling after the soaking, it may be done by using gas or water jet stream, but it is preferable to use water-cooled rolls because the formation of oxide film on the strip surface is prevented and the cooling rate and the final cooling temperature can be consistently controlled.

Regarding the cooling rate from $A_1$ point, the desired result can be obtained with a cooling rate not less than 30° C./sec so far as the final cooling temperature is within the defined range, but it may be varied within a range of from 30° to 200° C./sec. depending on the carbon contents in the steel.

The steel strips as overaged according to the present invention have a lowered content of solid solution carbon, thus showing excellent ductility. Therefore, where it is required to completely remove the yield point elongation after the overageing, it is desirable to increase the temper rolling reduction higher than usual, but not higher than 3%, even with some sacrifice of ductility.

DESCRIPTION OF PREFERRED EMBODIMENTS

The present invention will be better understood from the following description of preferred embodiments made with reference to the accompanying drawings Converter steels shown in Table 1 after composition adjustments by molten pig-iron treatment or molten steel treatment are continuously cast into slabs of 220 mm in thickness, which are subjected to hot rolling into hot rolled steel strips of 3.5 mm thickness in the form of 20 ton coil under the conditions:

soaking temperature—1250° C.,
finishing temperature—930° C. ($A_3$ point 890° C.),
coiling temperature—600°-700° C.

Then the hot strip coils are acid-pickled and cold rolled into cold rolled strips of 0.8 mm in thickness. These cold rolled strips are then subjected to the heat treatments according to the continuous annealing cycles (I), (II) and (III) shown in FIG. 1. In FIG. 1, the cooling rate from $A_1$ point is expressed by $\alpha$ (°C./sec.), the final cooling temperature by $\alpha$° C./sec. is expressed by $T_1$(°C.), the holding time at the temperature $T_1$(°C.) is expressed by $t_1$ (min.), the second step overageing treatment temperature is expressed by $T_2$ (°C.), and the holding time at the temperature $T_2$(°C.) is expressed by $t_2$(min.). These numerical data are shown in Table 2.

The cooling from the soaking temperature to $A_1$ point is done with a constant cooling rate and from the first step overageing temperature to the second step overageing temperature, with a cooling rate of about 10° C./sec. and the final step cooling is done by water through a temperature range below 200° C.

The steel strips treated by the individual heat cycles are temper rolled with 1.0% reduction to prepare No.5 tensile test piece according to JIS Z 2201.

Also, the liquid pressure bulge tests are conducted using a 100 mm diameter disc bead to estimate the forming height before the fracture takes place.

The various mechanical properties of steel strips having chemical compositions shown in Table 1, are heat-treated under the conditions shown in Table 2.

As clearly understood from Table 3, the cold rolled steel strips produced according to the present invention show an excellent press formability and a yield point after the overageing equal to or better than that obtained by the box annealing, and thus the strips produced according to the present invention can be advantageously non-aged for practical purposes.

In Table 3, the designation symbols, D, E and G represent the steel strips produced according to the present invention. As clearly shown these strips have markedly improved elongation and bulge forming height values, yet show a yield point elongation value not higher than 0.1%, thus they are practically non-ageing. The strip A is outside the scope of the present invention, because the cooling rate ($\alpha$) is lower, the strip B illustrates the case where the final cooling temperature is too high and the strip C illustrates the case where the second step overageing temperature is too low. All of these strips show a low elongation value, at most about 40%, and show a yield point elongation value of 0.8% or higher. Therefore, these strips are not satisfactory from the point of ageing property. It will be noted that when the steel compositions and the cooling conditions in the continuous annealing are within the scope of the present invention, quite excellent steel strips can be obtained as illustrated by the strips D and E. It is particularly worthy to be noted that the yield point elongation even after the overageing is not higher than 0.1%, which indicates substantially non-ageing property, and that the bulge forming height is also higher than that of conventional Al-killed steel strips produced by the box annealing. In the case of the strip F, the phosphorus content is high, because no molten pig-iron treatment, nor molten steel treatment has been performed. In this case, the material quality is inferior and the yield point elongation is apparent despite the cooling conditions in accordance with the present invention. The strip G contains boron and is produced according to the present invention. In this case, excellent workability can be obtained even if the coiling temperature in the hot rolling is 600° C. which is the lower limit of the temperature range defined in the present invention.

In the case of the strip H, the phosphorus content is lowered, and the coiling temperature is 700° C. which is close to the upper limit of the temperature range defined in the present invention. However, in the annealing process, the conventional heat cycle II shown in FIG. 1 is applied. Also in the case of the strip I, the conventional heat cycle III is applied. In these cases, H and I, the elongation and the bulge forming height are inferior.

Meanwhile, the amount of solid solution carbon in the steel strips produced according to the present invention is estimated to be not larger than 3.0 ppm as determined by the internal friction method. This indicates that the ageing property, which is very important to cold rolled steel strips, is quite excellent.

Regarding the holding at the second step cooling temperature for one to three minutes, even when the strips are passed through a zone where burners are non-operative due to the heat energy supply conditions of the annealing furnace, namely even if the temperature of the strips temporarily drops, similar effects can be obtained as obtained by a constant holding temperature so far as the temperature remains within the range of from 450° to 350° C.

TABLE 1

| Steel No. | C % | Mn % | P % | Al % | N % | B % | Soaking Temp. °C. | Finishing Temp. °C. | Coiling Temp. °C. | Remarks |
|---|---|---|---|---|---|---|---|---|---|---|
| 1 | 0.027 | 0.23 | 0.005 | 0.034 | 0.0028 | — | 1250 | 930 | 650 | Present Invention |
| 2 | 0.022 | 0.19 | 0.003 | 0.029 | 0.0019 | — | 1250 | 930 | 620 | Present Invention |
| 3 | 0.025 | 0.22 | 0.019 | 0.026 | 0.0028 | — | 1250 | 930 | 650 | Comparative |
| 4 | 0.032 | 0.23 | 0.006 | 0.024 | 0.0022 | 0.0020 | 1250 | 930 | 600 | Present Invention |
| 5 | 0.035 | 0.25 | 0.008 | 0.028 | 0.0022 | — | 1250 | 930 | 700 | Present Invention |

TABLE 2

| Heat Treatment No. | Heat Cycle shown in FIG. 1 | Heating Rate °C./sec. | Continuous Annealing Conditions: Heating & Soaking Temp. °C. | Holding Time sec. | α °C./sec. | $T_1$ | $t_1$ | $T_2$ | $t_2$ | Steel Composition |
|---|---|---|---|---|---|---|---|---|---|---|
| 1 | I | 10 | 820 | 40 | 10 | 400 | 3 | 300 | 3 | Comparative |
| 2 | I | " | " | " | 70 | 500 | 2 | 200 | 5 | " |
| 3 | I | " | " | " | 100 | 400 | 3 | 180 | 10 | " |
| 4 | I | " | " | " | 70 | 400 | 3 | 300 | 2 | Present Invention |
| 5 | I | 10 | 820 | 40 | 50 | 400 | 3 | 250 | 5 | Present Invention |
| 6 | I | 10 | 820 | 40 | 70 | 350 | 3 | 300 | 3 | Comparative |
| 7 | I | " | " | " | 70 | 400 | 2 | 300 | 2 | Present Invention |
| 8 | II | 10 | 820 | 40 | 10 | 400 | 3 | — | — | Comparative |
| 9 | III | " | " | " | Water Cooling | 400 | 3 | — | — | " |

TABLE 3

| Product No. | Steel No. | Heat Treatment No. | Mechanical Properties: Yield Point kg/mm² | Tensile Strength kg/mm² | Elongation % | Yield Point Elongation % | Bulge Height mm | Remarks |
|---|---|---|---|---|---|---|---|---|
| A | 1 | 1 | 23.2 | 34.8 | 42 | 0.8 | 33.2 | Comparative |
| B | 1 | 2 | 24.0 | 35.0 | 39 | 1.0 | 32.8 | " |
| C | 1 | 3 | 24.2 | 35.4 | 38 | 0.8 | 32.5 | " |
| D | 1 | 4 | 17.2 | 34.0 | 46 | 0.1 | 37.5 | Present Invention |
| E | 2 | 5 | 17.6 | 34.1 | 47 | 0 | 38.0 | Present Invention |
| F | 3 | 6 | 21.3 | 35.2 | 42 | 0.8 | 34.0 | Comparative |
| G | 4 | 7 | 18.0 | 34.3 | 44 | 0.1 | 36.2 | Present Invention |
| H | 5 | 8 | 23.8 | 35.7 | 40 | 0.8 | 33.0 | Comparative |
| I | 5 | 9 | 23.6 | 35.6 | 40 | 0.4 | 31.8 | " |

What we claim:

1. A process for producing cold rolled steel strips having excellent press formability and ageing property comprising:

continuously casting molten steel containing carbon, manganese, phosphorus, aluminum and nitrogen; the carbon being not more than 0.1%, the manganese being not more than 0.5%, the phosphorus being not more than 0.0008%, the aluminum being 0.02 to 0.08%, the nitrogen being 0.0019 to 0.0005%, with the balance being iron and unavoidable impurities, into steels slabs;

continuously hot rolling the slabs with a finishing temperature not lower than $A_3$ point, and a coiling temperature from 600° to 750° C.;

cold rolling the hot rolled strips thus obtained;

then subjecting the cold rolled strips thus obtained to continuous annealing which comprises heating the strips to a temperature ranging of from 680° to 850° C., cooling the strips with a cooling rate not less than 50° C./sec. through a temperature range of from $A_1$ point to a temperature ranging of from 450° to 350° C., holding the strips isothermally at the temperature thus cooled for one to 3 minutes, further cooling the strips to a temperature ranging from 300° to 200° C., holding the strips again isothermally at the temperature thus cooled for at least one minute, and finally cooling the strips to room temperature, the steel strip having a yield point elongation not higher than 0.1%.

2. A process according to claim 1 where there is present 0.02 to 0.1% carbon and 0.003 to 0.008% P.

3. A process according to claim 2 wherein there is present 0.19 to 0.5% manganese, 0.02 to 0.08% aluminum and 0.0019 to 0.005% nitrogen.

4. A process according to claim 1 wherein there is present 0.003 to 0.008% P.

5. A process according to claim 4 wherein there is present 0.02 to 0.1% carbon, 0.19 to 0.5% manganese, 0.02 to 0.08% aluminum and 0.0019 to 0.005% nitrogen.

6. A process according to claim 1 wherein the cooling rate is 50° C./sec. to 70° C./sec.

7. A process according to claim 2 wherein the cooling rate is 50° C./sec. to 70° C./sec.

8. A process according to claim 3 wherein the cooling rate is 50° C./sec. to 70° C./sec.

9. A process according to claim 4 wherein the cooling rate is 50° C./sec. to 70° /sec.

10. A process according to claim 5 wherein the cooling rate is 50° C./sec. to 70° C./sec.

* * * * *